US007648782B2

(12) United States Patent
Kobayashi et al.

(10) Patent No.: US 7,648,782 B2
(45) Date of Patent: Jan. 19, 2010

(54) CERAMIC COATING MEMBER FOR SEMICONDUCTOR PROCESSING APPARATUS

(75) Inventors: Yoshiyuki Kobayashi, Tokyo (JP); Takahiro Murakami, Tokyo (JP); Yoshio Harada, Akashi (JP); Junichi Takeuchi, Kobe (JP); Ryo Yamasaki, Kakogawa (JP); Keigo Kobayashi, Funabashi (JP)

(73) Assignees: Tokyo Electron Limited, Tokyo (JP); Tocalo Co., Ltd., Kobe-shi (JP)

( * ) Notice: Subject to any disclaimer, the term of this patent is extended or adjusted under 35 U.S.C. 154(b) by 0 days.

(21) Appl. No.: 11/688,565

(22) Filed: Mar. 20, 2007

(65) Prior Publication Data

US 2007/0218302 A1 Sep. 20, 2007

Related U.S. Application Data

(60) Provisional application No. 60/809,409, filed on May 31, 2006.

(30) Foreign Application Priority Data

Mar. 20, 2006 (JP) ..... 2006-076196

(51) Int. Cl.

| | |
|---|---|
| ***H01L 29/04*** | (2006.01) |
| ***H01L 21/473*** | (2006.01) |
| ***H01L 21/461*** | (2006.01) |
| ***H01L 21/3105*** | (2006.01) |
| ***B01J 3/08*** | (2006.01) |
| ***B01J 19/08*** | (2006.01) |
| ***B05D 3/06*** | (2006.01) |
| ***B05D 1/06*** | (2006.01) |
| ***C08J 7/18*** | (2006.01) |
| ***C23C 4/10*** | (2006.01) |
| ***C01F 17/00*** | (2006.01) |
| ***C04B 35/505*** | (2006.01) |

(52) U.S. Cl. ..... 428/701; 438/778; 438/761; 501/152; 252/604; 427/263; 427/126.3; 427/331; 427/453; 427/457; 427/508; 427/551; 427/554; 427/532; 428/544

(58) Field of Classification Search ..... 428/701
See application file for complete search history.

(56) References Cited

U.S. PATENT DOCUMENTS 3,663,793 A 5/1972 Petro et al.

(Continued)

FOREIGN PATENT DOCUMENTS

EP 0 822 584 A2 2/1998

(Continued)

OTHER PUBLICATIONS

U.S. Appl. No. 11/688,501, filed Mar. 20, 2007, Kobayashi.

(Continued)

*Primary Examiner*—David R Sample
*Assistant Examiner*—Nicole T Gugliotta
(74) *Attorney, Agent, or Firm*—Oblon, Spivak, McClelland, Maier & Neustadt, L.L.P.

(57) ABSTRACT

Improving the resistance of members and parts disposed inside of vessels such as semiconductor processing devices for conducting plasma etching treatment in a strong corrosive environment. A ceramic coating member for a semiconductor processing apparatus comprises a porous layer made of an oxide of an element in Group IIIb of the Periodic Table coated directed or through an undercoat on the surface of the substrate of a metal or non-metal and a secondary recrystallized layer of the oxide formed on the porous layer through an irradiation treatment of a high energy such as electron beam and laser beam.

16 Claims, 4 Drawing Sheets

U.S. PATENT DOCUMENTS

| | | | | | |
|---|---|---|---|---|---|
| 3,990,860 | A | | 11/1976 | Fletcher et al. | |
| 4,205,051 | A | * | 5/1980 | Takahashi et al. | 423/266 |
| 4,219,359 | A | * | 8/1980 | Miwa et al. | 501/135 |
| 4,536,228 | A | | 8/1985 | Treharne | |
| 4,997,809 | A | | 3/1991 | Gupta | |
| 5,004,712 | A | | 4/1991 | Borglum | |
| 5,024,992 | A | * | 6/1991 | Morris | 505/482 |
| 5,032,248 | A | | 7/1991 | Kanamaru et al. | |
| 5,057,335 | A | * | 10/1991 | Hanagata et al. | 427/512 |
| 5,093,148 | A | | 3/1992 | Christodoulou et al. | |
| 5,128,316 | A | * | 7/1992 | Agostinelli et al. | 505/237 |
| 5,206,059 | A | | 4/1993 | Marantz | |
| 5,316,859 | A | | 5/1994 | Harada et al. | |
| 5,397,650 | A | | 3/1995 | Harada et al. | |
| 5,427,823 | A | | 6/1995 | Varshney et al. | |
| 5,432,151 | A | * | 7/1995 | Russo et al. | 505/474 |
| 5,472,793 | A | | 12/1995 | Harada et al. | |
| 5,562,840 | A | * | 10/1996 | Swain et al. | 216/65 |
| 5,909,354 | A | | 6/1999 | Harada et al. | |
| 5,922,275 | A | | 7/1999 | Kageyama et al. | |
| 6,045,665 | A | | 4/2000 | Ohhashi et al. | |
| 6,120,640 | A | | 9/2000 | Shih et al. | |
| 6,132,890 | A | | 10/2000 | Harada et al. | |
| 6,180,259 | B1 | | 1/2001 | Harada et al. | |
| 6,250,251 | B1 | | 6/2001 | Akiyama et al. | |
| 6,261,962 | B1 | | 7/2001 | Bhardwaj et al. | |
| 6,306,489 | B1 | | 10/2001 | Hellmann et al. | |
| 6,319,419 | B1 | | 11/2001 | Ohhashi et al. | |
| 6,326,063 | B1 | | 12/2001 | Harada et al. | |
| 6,383,964 | B1 | | 5/2002 | Nakahara et al. | |
| 6,447,853 | B1 | | 9/2002 | Suzuki et al. | |
| 6,509,070 | B1 | * | 1/2003 | Voevodin et al. | 427/572 |
| 6,547,921 | B2 | | 4/2003 | Suzuki et al. | |
| 6,558,505 | B2 | | 5/2003 | Suzuki et al. | |
| 6,738,863 | B2 | | 5/2004 | Butterworth et al. | |
| 6,771,483 | B2 | | 8/2004 | Harada et al. | |
| 6,777,045 | B2 | | 8/2004 | Lin et al. | |
| 6,783,863 | B2 | | 8/2004 | Harada et al. | |
| 6,797,957 | B2 | * | 9/2004 | Kawakubo et al. | 250/338.2 |
| 6,805,968 | B2 | | 10/2004 | Saito et al. | |
| 6,834,613 | B1 | | 12/2004 | Miyazaki et al. | |
| 6,852,433 | B2 | | 2/2005 | Maeda | |
| 6,884,516 | B2 | | 4/2005 | Harada et al. | |
| 6,916,534 | B2 | * | 7/2005 | Wataya et al. | 428/402 |
| 7,494,723 | B2 | | 2/2009 | Harada et al. | |
| 7,497,598 | B2 | | 3/2009 | Masaki et al. | |
| 7,535,868 | B2 | | 5/2009 | Black et al. | |
| 2004/0061431 | A1 | * | 4/2004 | Takeuchi et al. | 313/495 |
| 2004/0214026 | A1 | | 10/2004 | Harada et al. | |
| 2005/0103275 | A1 | | 5/2005 | Sasaki et al. | |
| 2005/0136188 | A1 | * | 6/2005 | Chang | 427/421.1 |
| 2005/0147852 | A1 | | 7/2005 | Harada et al. | |
| 2006/0009944 | A1 | | 1/2006 | Shah et al. | |
| 2006/0099457 | A1 | | 5/2006 | Moriya et al. | |
| 2007/0026246 | A1 | | 2/2007 | Harada et al. | |
| 2007/0054092 | A1 | | 3/2007 | Harada et al. | |
| 2007/0218302 | A1 | | 9/2007 | Kobayashi et al. | |
| 2009/0120358 | A1 | | 5/2009 | Harada et al. | |
| 2009/0130436 | A1 | | 5/2009 | Harada et al. | |

FOREIGN PATENT DOCUMENTS

| | | | |
|---|---|---|---|
| EP | 1 156 130 | A1 | 11/2001 |
| JP | 50-075370 | | 6/1975 |
| JP | 58-192661 | | 11/1983 |
| JP | 58-202535 | | 11/1983 |
| JP | 59-96273 | | 6/1984 |
| JP | 61-30658 | | 2/1986 |
| JP | 61-104062 | | 5/1986 |
| JP | 61-113755 | | 5/1986 |
| JP | 62-253758 | | 11/1987 |
| JP | 64-039728 | | 2/1989 |
| JP | 01-139749 | | 6/1989 |
| JP | 03-115535 | | 5/1991 |
| JP | 03-247769 | | 11/1991 |
| JP | 04-202660 | | 7/1992 |
| JP | 4-276059 | | 10/1992 |
| JP | 05-117064 | | 5/1993 |
| JP | 05-238859 | | 9/1993 |
| JP | 06-057396 | | 3/1994 |
| JP | 06-136505 | | 5/1994 |
| JP | 06-142822 | | 5/1994 |
| JP | 06-196421 | | 7/1994 |
| JP | 06-220618 | | 8/1994 |
| JP | 07-035568 | | 4/1995 |
| JP | 07-102366 | | 4/1995 |
| JP | 07-126827 | | 5/1995 |
| JP | 07-176524 | | 7/1995 |
| JP | 08-037180 | | 2/1996 |
| JP | 08-339895 | | 12/1996 |
| JP | 09-048684 | | 2/1997 |
| JP | 09-069554 | | 3/1997 |
| JP | 09-216075 | | 8/1997 |
| JP | 09-272987 | | 10/1997 |
| JP | 09-316624 | | 12/1997 |
| JP | 10-4083 | | 1/1998 |
| JP | 10-045461 | | 2/1998 |
| JP | 10-045467 | | 2/1998 |
| JP | 10-144654 | | 5/1998 |
| JP | 10-163180 | | 6/1998 |
| JP | 10-202782 | | 8/1998 |
| JP | 10-226869 | | 8/1998 |
| JP | 10-330971 | | 12/1998 |
| JP | 11-080925 | | 3/1999 |
| JP | 11207161 | | 8/1999 |
| JP | 11-345780 | | 12/1999 |
| JP | 2000-54802 | | 2/2000 |
| JP | 2000-072529 | | 3/2000 |
| JP | 3076768 | | 6/2000 |
| JP | 2000-191370 | | 7/2000 |
| JP | 2000-228398 | | 8/2000 |
| JP | 2001-031484 | | 2/2001 |
| JP | 2001-164354 | | 6/2001 |
| JP | 2001-164354 | A | 6/2001 |
| JP | 2001-335915 | | 12/2001 |
| JP | 2001-342553 | | 12/2001 |
| JP | 2002-80954 | | 3/2002 |
| JP | 2002-89607 | | 3/2002 |
| JP | 2003-95649 | | 4/2003 |
| JP | 2003-264169 | | 9/2003 |
| JP | 2003-321760 | | 11/2003 |
| JP | 2004-003022 | | 1/2004 |
| JP | 2004-10981 | | 1/2004 |
| JP | 2004-149915 | | 5/2004 |
| JP | 2004-190136 | | 7/2004 |
| JP | 2004-522281 | | 7/2004 |
| JP | 2004-269951 | | 9/2004 |
| JP | 2005-256098 | | 9/2005 |
| JP | 2006-118053 | A | 5/2006 |
| JP | 2007-070175 | A | 3/2007 |
| JP | 2007-138302 | A | 6/2007 |
| JP | 2007-516921 | | 6/2007 |
| JP | 2007-314886 | A | 12/2007 |
| KR | 10-0248081 | | 12/1999 |
| KR | 10-0268052 | | 10/2000 |
| KR | 2002-0003367 | | 1/2002 |
| KR | 10-2007-030718 | | 3/2007 |
| WO | WO 01/42526 | A1 | 6/2001 |
| WO | WO2004/095532 | A2 * | 11/2004 |
| WO | WO 2005/062758 | | 7/2005 |
| WO | WO 2007/013181 | A1 | 2/2007 |
| WO | WO 2007-013184 | | 2/2007 |

| | | |
|---|---|---|
| WO | WO 2007-023971 | 3/2007 |
| WO | WO 2007-023976 | 3/2007 |

OTHER PUBLICATIONS

U.S. Appl. No. 11/688,565, filed Mar. 20, 2007, Kobayashi, et al.

Masakatsu Magome, "The p. 33 of Spray Coating Technical Manual", Series of JIS Manual, issued by Japanese Standards Association on Oct. 30, 1998, 7 pages (including English translation).

Magome, Masakatsu, JIS Using Series: Spraying Technique Manual, p. 95, Oct. 30, 1998. (with English translation).

* cited by examiner

CERAMIC COATING MEMBER FOR SEMICONDUCTOR PROCESSING APPARATUS

FIELD OF THE INVENTION

This invention relates to a ceramic coating member for a semiconductor processing apparatus, which is more particularly used as a coating member for members, parts and the like disposed in a semiconductor treating vessel for conducting a plasma etching process or the like.

BACKGROUND OF THE INVENTION

In devices used in the field of semiconductor or liquid crystal, they are frequently processed by using plasma energy of a halogen-based corrosive gas having a high corrosion property. For example, the fine wiring pattern to be formed by the semiconductor processing device is formed by fine processing (etching) utilizing a strong reactivity of ion or electron excited when a plasma is generated in a strongly corrosive gas atmosphere of a fluorine or chlorine or a mixed gas atmosphere with an inert gas thereof.

In case of such a processing technique, the members or parts (susceptor, electrostatic chuck, electrode and others) disposed in at least a part of the wall face of the reaction vessel or in the inside thereof are easily subjected to an erosion action through a plasma energy, and hence it is important to use a material having an excellent resistance to erosion. As the material satisfying such a requirement, inorganic materials such as a metal having a good corrosion resistance (inclusive of an alloy), quartz and alumina have been used. For example, JP-A-H10-4083 discloses a method wherein the inorganic material is applied onto the surface of the part inside the reaction vessel through PVD process or CVD process or a dense film made of an oxide of an element in Group IIIb of the Periodic Table is formed thereon or a $Y_2O_3$ single crystal is applied thereonto. Also, JP-A-2001-164354 discloses technique that the resistance to plasma erosion is improved by applying $Y_2O_3$ as an oxide of an element belonging to Group IIIb of the Periodic Table onto the surface of the member through spray process.

However, the conventional method of covering with the oxide of the element of Group IIIb is not yet sufficient in the recent semiconductor processing technique requiring high precision processing and environmental cleanness in a further severer corrosive gas atmosphere.

Also, the member covered with the $Y_2O_3$ spray coating as disclosed in JP-A-2001-164354 is demanded to be more improved considering that the recent processing of the semiconductor part is subjected to a plasma etching action at a higher output and under a severer condition alternately and repeatedly using a fluorine gas and a hydrocarbon gas as a processing atmosphere.

For example, the F-containing gas atmosphere causes the formation of a fluoride having a high steam pressure through a strong corrosion reaction inherent to the halogen gas, while the CH-containing gas atmosphere promotes the decomposition of the fluorine compound produced in the F-containing gas and change a part of the film element into a carbide to enhance the reaction of forming the fluoride. Further, the above reaction is promoted under a plasma environment in the F-containing gas atmosphere to form a very severe corrosion environment. Moreover, particles as a corrosion product are produced in such an environment, which drop down and adhere onto a surface of an integrated circuit in the semiconductor product to result in a cause of damaging the device.

SUMMARY OF THE INVENTION

A main object of the invention is to propose a ceramic coating member used as a member or a part used in a plasma etching in a corrosive gas atmosphere and disposed in a semiconductor processing vessel.

Another object of the invention is to provide a member having an excellent durability to plasma erosion in a corrosive gas atmosphere and capable of suppressing the formation of contaminant substance (particles) and lessening a burden for the maintenance of the apparatus.

In order to achieve the above objects, the invention proposes a ceramic coating member for a semiconductor processing apparatus comprising a substrate, a porous layer made of an oxide of an element in Group IIIb of the Periodic Table coated on the surface of this substrate and a secondary recrystallized layer of the oxide formed on the porous layer.

In a preferable embodiment of the invention, an undercoat is disposed between the substrate and the porous layer.

In a preferable embodiment of the invention, the substrate is (i) aluminum and an alloy thereof, titanium and an alloy thereof, stainless steel and other special steels, Ni-based alloy, and other metals and alloys thereof, (ii) a ceramic of quartz, glass, an oxide, a carbide, a boride, a silicide, a nitride or a mixture thereof, (iii) a cermet of the above ceramic and the above metal or alloy, (iv) plastics, and (v) a metal plating (electric plating, fusion plating and chemical plating) or an evaporated metal film formed on the surface of the above material (i)-(iv).

In a preferable embodiment of the invention, the porous layer is an oxide of Sc, Y or a lanthanide of atom number 57-71 (La, Ce, Pr, Nb, Pm, Sm, Eu, Gd, Tb, Dy, Ho, Er, Tm, Yb, Lu).

In a preferable embodiment of the invention, the porous layer is a spray coating having a layer thickness of about 50-2000 μm and a porosity of about 5-20%.

In a preferable embodiment of the invention, the secondary recrystallized layer is a high energy irradiation treated layer formed by changing a primary transformed oxide included in the porous layer into a secondary transformed one through a high energy irradiation treatment.

In an embodiment of the invention, the porous layer containing a rhombic crystal is a layer having a tetragonal crystal structure by secondary transformation through a high energy irradiation treatment and a porosity of less than 5%.

In a preferable embodiment of the invention, the secondary recrystallized layer is a layer formed by subjecting a primary transformed spray coating of yttrium oxide consisting of a cubic crystal and a monoclinic crystal to a high energy irradiation treatment to render into a secondary transformed cubic crystal.

In a preferable embodiment of the invention, the secondary recrystallized layer has a maximum roughness (Ry) of about 6-16 μm, an average roughness (Ra) of about 3-6 μm and a 10-point average roughness (Rz) of about 8-24 μm.

In a preferable embodiment of the invention, the layers have a total layer thickness of about 100 μm or less.

In a preferable embodiment of the invention, the high energy irradiation treatment is a treatment of an electron beam irradiation or a laser beam irradiation.

In a preferable embodiment of the invention, the undercoat is a coating film formed by at least one ceramic selected from Ni, Al, W, Mo, Ti and an alloy thereof, at least one ceramic of an oxide, a nitride, a boride and a carbide and also by a cermet consisting of the above metal, alloy and ceramic and formed to be about 50-500 μm in thickness.

The ceramic coating member for the semiconductor processing apparatus having the above construction according to the invention develops a strong resisting force against a plasma erosion action in an atmosphere containing a gas of a halogen compound and/or an atmosphere containing a hydrocarbon gas, particularly under a corrosive environment alternately and repeating both these atmospheres over a long time of period and is excellent in the durability.

Also, the ceramic coating member according to the invention is less in the generation of fine particles made from the coating constitutional element or the like produced when being subjected to a plasma etching under the above corrosive environment and does not bring about the environmental contamination. Therefore, it is possible to efficiently produce high-quality semiconductor elements and the like.

Further, according to the invention, the contamination by the particles becomes less, so that the cleaning operation for the semiconductor processing apparatus or the like is mitigated, which contributes to the improvement of the productivity. Moreover, according to the invention, it is possible to enhance the etching effect and speed by increasing the output of the plasma, so that there is developed an effect that the whole of the semiconductor production system is improved by the miniaturization and weight reduction of the apparatus.

DESCRIPTION OF THE PREFERRED EMBODIMENTS

Figure 1:
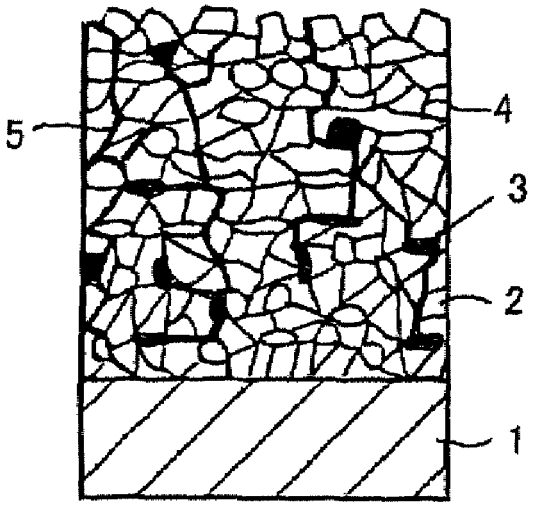
FIG. 1 is a partial section view illustrating (a) a member having the conventional spray coating, (b) a member having a secondary recrystallized layer as an outermost layer and (c) a member having an undercoat.
Figure 1:
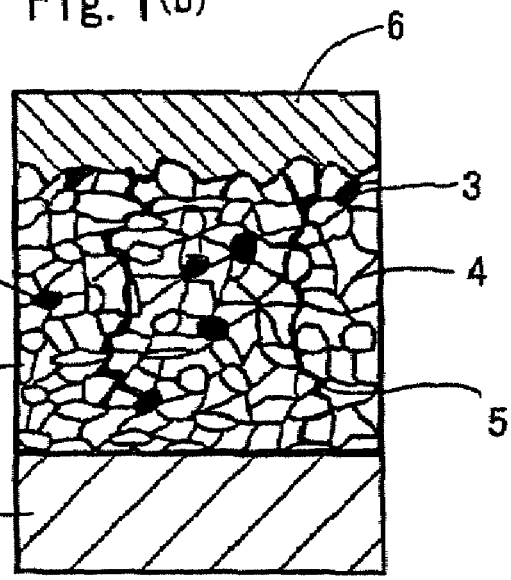
Figure 1:
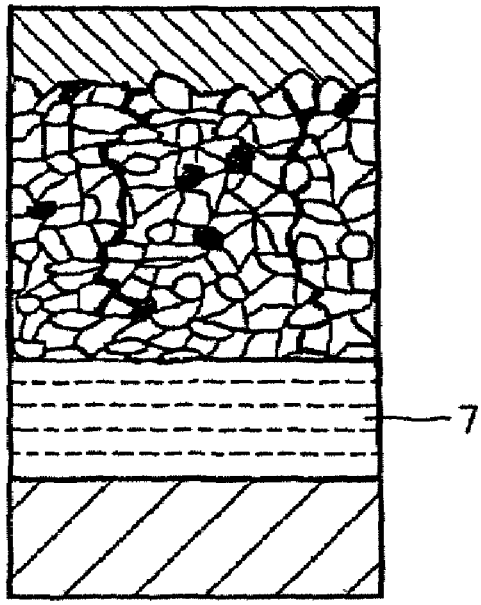

The ceramic coating member for semiconductor processing apparatus according to the invention functions most effectively when a semiconductor element is used in a member, part or the like exposed to an environment of a plasma etching in a corrosive gas atmosphere. Such an environment means an atmosphere violently causing the corrosion of the members and the like, particularly a gas atmosphere containing fluorine or a fluorine compound (hereinafter referred to as F-containing gas), an atmosphere containing a gas of $SF_6$, $CF_4$, $CHF_3$, $ClF_3$, HF or the like, an atmosphere of a hydrocarbon gas such as $C_2H_2$ and $CH_4$ (hereinafter referred to as CH-containing gas) or an atmosphere alternately repeating these both atmospheres.

The F-containing gas atmosphere mainly contains fluorine or the fluorine compound or may further contain oxygen ($O_2$). Fluorine is particularly highly reactive (strongly corrosive) among the halogen elements and is characterized by reacting with not only a metal but also with an oxide or a carbide to form a corrosive product having a high vapor pressure. For this end, the metal, oxide, carbide and the like existing in the F-containing gas atmosphere does not form a protection film for controlling the proceeding of the corrosion reaction on the surface, and hence the corrosion reaction is proceeded without limit. As mentioned in detail later, however, the elements belonging to Group IIIb of the Periodic Table such as Sc and Y elements of atomic numbers 57-71 as well as oxides thereof indicate the relatively good corrosion resistance even under such an environment.

On the other hand, the CH-containing gas atmosphere is characterized by generating a reduction reaction quite opposite to the oxidation reaction proceeding in the F-containing gas atmosphere though CH itself does not have a strong corrosiveness. For this end, when the metal or metal compound indicating the relatively stable corrosion resistance in the F-containing gas atmosphere come into contact with the CH-containing gas atmosphere, the chemical bonding force becomes weak. Also, when the portion contacting with the CH-containing gas is again exposed to the F-containing gas atmosphere, it is considered that the initial stable compound film is chemically destroyed to finally bring about the phenomenon of promoting the corrosion reaction.

Particularly, under an environment of generating plasma, in addition to the changes of the above atmosphere gas, F and CH are ionized to generate atomic F or CH having a strong reactivity, whereby the corrosiveness and reduction property are made more violent and the corrosion product is easily produced.

The thus produced corrosion product is vaporized under the plasma environment or rendered into fine particles to considerably contaminate the interior of the plasma treating vessel. Therefore, it is considered that the invention is effective as a countermeasure on the corrosion under the environment alternately repeating the F-containing atmosphere and the CH-containing atmosphere and serves not only the prevention from the formation of the corrosion product but also the control of the generation of particles.

The inventors have made studies on the material showing good resistance to corrosion and environmental contamination in the atmosphere of F-containing gas or CH-containing gas. As a result, it has been found that it is effective to use an oxide of an element belonging to Group IIIb of the Periodic Table as a material covering the surface of the substrate. Concretely, an oxide of Sc, Y or a lanthanide of atom number 57-71 (La, Ce, Pr, Nb, Pm, Sm, Eu, Gd, Tb, Dy, Ho, Er, Tm, Yb, Lu), particularly a rare earth element oxide of La, Ce, Eu, Dy or Yb is found to be preferable. In the invention, these oxides may be used alone or in an admixture, composite oxide, eutectic mixture of two or more. The reason why the above metal oxides are noticed in invention is due to the fact that they are excellent in the resistance to halogen corrosion and the resistance to plasma erosion as compared with the other oxides.

As the substrate in the ceramic coating member according to the invention can be used (i) aluminum and an alloy thereof, titanium and an alloy thereof, stainless steel and other special steels, Ni-based alloy, and other metals and alloys thereof, (ii) a ceramic of quartz, glass, an oxide, a carbide, a boride, a silicide, a nitride or a mixture thereof, (iii) a cermet of the above ceramic and the above metal or alloy, (iv) plastics, and (v) a metal plating (electric plating, fusion plating, chemical plating) or a metal deposited film formed on the surface of the above material (i)-(iv).

As seen from the above, the feature of the invention lies in that the surface of the substrate is coated with the oxide of the element in Group IIIb of the Periodic Table developing excellent resistance to corrosion, environmental contamination and the like under a corrosion environment. As a coating means the following methods are adopted.

In the invention, a spraying method is used as a preferable example of the method of forming a porous layer coating having a given thickness on the surface of the substrate. According to the invention, the oxide of the Group IIIb element is first pulverized to form a spraying powder material having a particle size of 5-80 μm, which is sprayed onto the surface of the substrate by a predetermined method to form a porous layer consisting of a porous spray coating having a thickness of 50-2000 μm.

As the method of spraying the oxide powder are preferable an atmospheric plasma spraying method and a low pressure plasma spraying method, but a water stabilized plasma spraying method, a detonation spraying method or the like is applicable in accordance with use conditions.

In the spray coating (porous layer) obtained by spraying the oxide powder of the Group IIIb element, when the thickness is less than 50 μm, the performances as the coating under the corrosion environment are not sufficient, while when it exceeds 2000 μm, the bonding force between the mutual spraying particles becomes weak and the stress generated in the formation of the coating (which is considered to be mainly caused by the shrinkage of volume due to the quenching of the particles) becomes large, which makes the coating become easily broken.

Moreover, the porous layer (spray coating) is directly formed on the substrate or on the undercoat formed on the substrate in advance.

The undercoat is preferable to be a metallic coating of Ni and alloy thereof, Co and alloy thereof, Al and alloy thereof, Ti and alloy thereof, Mo and alloy thereof, W and alloy thereof or Cr and alloy thereof formed through a spraying method or a vapor deposition method and have a thickness of about 50-500 μm.

The undercoat plays a role for shielding the surface of the substrate from the corrosive environment to improve the corrosion resistance as well as to improve the adhesion property between the substrate and the porous layer. Therefore, when the thickness of the undercoat is less than 50 μm, the sufficient corrosion resistance is not obtained and it is difficult to form the uniform coating, while when it exceeds 500 μm, the effect of the corrosion resistance is saturated.

In the porous layer of the spray coating made of the oxide of the Group IIIb element, the average porosity is about 5-20%. The porosity differs in accordance with the kind of the spraying method adopted such as low pressure plasma spraying method and atmospheric plasma spraying method. A preferable average porosity is within a range of about 5-10%. When the average porosity is less than 5%, an action of mitigating thermal stress stored in the coating is weak and the resistance to thermal shock is poor, while when it exceeds 10%, particularly 20%, the corrosion resistance and resistance to plasma erosion are poor.

The surface of the porous layer (spray coating) has an average roughness (Ra) of about 3-6 μm, a maximum roughness (Ry) of about 16-32 μm and a 10-point average roughness (Rz) of about 8-24 μm in case of adopting the atmospheric plasma spraying method.

In the invention, the reason why the porous layer is the spray coating is due to the fact that such a coating is excellent in the resistance to thermal shock and is cheaply obtained at a given thickness in a short time. Further, this coating takes a buffering action for mitigating thermal shock applied to an upper dense secondary recrystallized layer to moderate the thermal shock applied to the coating entirely. With this meaning, when a composite coating is formed by disposing the spray coating as a lower layer and forming the secondary recrystallized layer as an upper layer thereon, both the layers cause synergistically the effect of improving the durability as the coating.

A most characteristic construction of the invention lies in a point that the porous layer or the porous spray coating made of the oxide of the Group IIIb element is provided with a newly layer modifying an outermost surface portion of the spray coating, i.e. a secondary recrystallized layer obtained by secondarily transforming the porous layer made of the oxide of the Group IIIb element.

In case of the metal oxide of the Group IIIb element such as yttrium oxide (yttria: $Y_2O_3$), the crystal structure is generally a cubic system. When powder of yttrium oxide (hereinafter referred to as yttria) is plasma-sprayed, the molten particles are rapidly quenched while flying toward the substrate at a high speed and deposited on the surface of the substrate in collision and hence the crystal structure is primary-transformed into a crystal form made from a mixed crystal including a monoclinic crystal in addition to a cubic crystal.

That is, the crystal form of the porous layer is constituted with a crystal form consisting of a mixed crystal of a cubic crystal and monoclinic crystal through the primary transformation accompanied with the rapid quenching in the spraying.

On the contrary, the secondary recrystallized layer is a layer wherein the crystal form of the primary-transformed mixed crystal is secondary-transformed into a crystal form of a cubic crystal.

In the invention, therefore, the porous layer of the Group IIIb element oxide consisting of the mixed crystal structure mainly including the primary-transformed monoclinic crystal is subjected to a high energy irradiation treatment to heat the deposited spray particles in the porous layer at least above the melting point thereof to thereby transform the layer again, whereby the crystal structure is returned to the cubic crystal to provide a crystallographically stabilized layer.

At the same time, according to the invention, heat strain or mechanical strain stored in the deposited layer of spraying particles are released in the primary transformation in the spraying to chemically and physically stabilize the properties thereof and also to realize the densification and smoothening of the layer accompanied with the fusion. As a result, the secondary recrystallized layer made from the oxide of the Group IIIb metal is a dense and smooth layer as compared with the layer only spray coated.

Therefore, the secondary recrystallized layer is a densified layer having a porosity of less than 5%, preferably less than 2%, an average surface roughness (Ra) of 0.8-3.0 μm, a maximum roughness (Ry) of 6-16 μm and a 10 point average roughness (Rz) of about 3-14 μm, which is a layer considerably different from the porous layer. Moreover, the control of the maximum roughness (Ry) is decided from a viewpoint of the resistance to environmental contamination. Because, when the surface of the member inside the vessel is cut out by a plasma ion or electron excited in the etching atmosphere to generate the particles, the influence is well represented in the value of the surface maximum roughness (Ry), and as the value becomes large, the chance of generating the particles increases.

Next, the high energy irradiation method for forming the secondary recrystallized layer previously mentioned is described. As the method adopted in the invention, an electron beam irradiation treatment and a laser irradiation treatment of $CO_2$ or YAG are preferable.

(1) Electron beam irradiation treatment: It is recommended to conduct this treatment by introducing an inert gas such as Ar gas into an air-evacuated irradiation chamber under the following conditions:

Irradiation atmosphere: 10-0.0005 Pa

Bead irradiating output: 0.1-8 kW

Treating rate: 1-30 m/s

Of course, these conditions are not limited to the above ranges as far as the predetermined effects of the invention are obtained.

The oxide of the Group IIIb element subjected to the electron beam irradiation treatment has its temperature rising from the surface and finally reaches above its melting point to become a fused state. Such a fusion phenomenon gradually comes into the interior of the coating as the irradiation output of the electron beam becomes high or the irradiation frequency increases or the irradiation time becomes long, so that the depth of the irradiation-fused layer can be controlled by changing the irradiation conditions. When the fusion depth is 100 μm or less, practically 1-50 μm, the secondary recrystallized layer achieving the above objectives is obtained.

(2) Laser beam irradiation treatment: It is possible to use YAG laser utilizing YAG crystal or $CO_2$ gas laser using a gas as a medium, or the like. In the laser beam irradiation treatment the following conditions are recommended:

Laser output: 0.1-10 kW

Laser beam area: 0.01-2500 $mm^2$

Treating rate: 5-1000 mm/s

As mentioned above, the layer subjected to the above electron beam irradiation treatment or laser beam irradiation treatment is changed into a physically and chemically stable crystal form by transforming at a high temperature and precipitating secondary recrystals in the cooling, so that the modification of the coating proceeds in a unit of crystal level. For example, the $Y_2O_3$ coating formed by the atmospheric plasma spraying method is a mixed crystal including the rhombic crystal at the sprayed state as previously mentioned, while it changes into substantially a cubic crystal after the electron beam irradiation.

The features of the secondary recrystallized layer made from the oxide of the Group IIIb element subjected to the high energy irradiation treatment are summarized as follows.

a) The secondary recrystallized layer produced by the high energy irradiation treatment being formed by further secondary-transforming the porous layer made of the metal oxide or the like as an underlayer primary transformed layer, or with the oxide particles of the underlayer being heated at above the melting point, is densified by disappearance of at least a part of pores.

b) When the secondary recrystallized layer produced by the high energy irradiation treatment is a layer formed by further secondary-transforming the porous layer made of the metal oxide or the like as an underlayer primary transformed layer and is a spray coating formed by the spraying method, particles remain unfused in the spraying are completely fused to render the surface into a mirror face state, so that projections liable to be plasma-etched disappear. That is, the maximum roughness (Ry) is 16-32 μm in case of the above porous layer, but the maximum roughness (Ry) of the secondary recrystallized layer after the above treatment is about 6-16 μm and the layer becomes remarkably smooth, and hence the occurrence of particles resulted in the contamination in the plasma etching is suppressed.

c) The porous layer is the secondary recrystallized layer produced by the high energy irradiation treatment owing to the above effects a) and b), so that the through-pores are clogged and the corrosive gas is not penetrated into the interior (substrate) through the through-pores and hence the corrosion resistance of the substrate is improved. Also, since the layer is densified, the strong resistance force to the plasma etching is developed to provide excellent resistance to corrosion and plasma erosion over a long time.

d) Since the secondary recrystallized layer has a porous layer therebelow, such a porous layer serves as a layer having an excellent resistance to thermal shock and acts as a buffering region and develops an effect of mitigating the thermal shock applied to the whole of the coating formed on the surface of the substrate through the action of mitigating the thermal shock applied to the upper dense secondary recrystallized layer. Particularly, when the secondary recrystallized layer is piled on the porous layer to form a composite layer, the effect becomes compound and synergistic.

Moreover, the secondary recrystallized layer produced by the high energy irradiation treatment is preferable to be a layer having a thickness ranging from 1 μm or more to 50 μm or less from the surface. The reason is that when the thickness is less than 1 μm, there is no effect by the formation of the coating, while when it exceeds 50 μm, the burden on the high energy irradiation treatment becomes large and the effect by the formation of the coating is saturated.

(Test 1)

In this test the state of forming the spray coating made of the oxide of the Group IIIb element and the state of a layer formed when the coating is exposed to an electron beam irradiation or a laser beam irradiation are examined. Moreover, as the IIIb oxide to be tested, 7 kinds of oxide powders of $Sc_2O_3$, $Y_2O_3$, $La_2O_3$, $CeO_2$, $Eu_2O_3$, $Dy_2O_3$ and $Yb_2O_3$ (average particle size: 10-50 μm) are used. These powders are directly sprayed on one-side surface of an aluminum test piece (size: width 50 mm×length 60 mm×thickness 8 mm) through atmospheric plasma spraying (APS) and low pressure plasma spraying (LPPS) to form a spray coating having a thickness of 100 μm. Thereafter, the surfaces of these coatings are subjected to an electron beam irradiation treatment and a laser beam irradiation treatment. The test results are shown in Table 1.

Moreover, the reason for conducting the test on the spraying method of the Group IIIb elements is to confirm whether there is the formation of the coating attainable for the object of the invention or not and whether there is the effect applied by the electron beam irradiation or not since the spraying experiment on the oxides of lanthanide metals of the atomic number of 57-71 has never been reported before.

From the test results, it has been seen that the test oxide is well fused even in the gas plasma heat source to form a relatively good coating though there are pores peculiar to the spray oxide coating as shown in the melting point of Table 1 (2300-2600° C.). It has also been confirmed that with the electron beam or the laser beam irradiating the coating surfaces, each coating turns to be dense and smooth surface as a whole by disappearance of projections through the fusion phenomenon.

TABLE 1

| Oxide | | | Forming method of coating | | Surface after high energy irradiation | |
|---|---|---|---|---|---|---|
| No. | Chemical formula | Melting point (° C.) | APS | LPPS | Electron beam | Laser beam |
| 1 | $Sc_2O_3$ | 2423 | ○ | ○ | smooth, dense | smooth, dense |
| 2 | $Y_2O_3$ | 2435 | ○ | ○ | smooth, dense | smooth, dense |
| 3 | $La_2O_3$ | 2300 | ○ | ○ | smooth, dense | smooth, dense |
| 4 | $CeO_2$ | 2600 | ○ | ○ | smooth, dense | smooth, dense |
| 5 | $Eu_2O_3$ | 2330 | ○ | ○ | smooth, dense | smooth, dense |
| 6 | $Dy_2O_3$ | 2931 | ○ | ○ | smooth, dense | smooth, dense |
| 7 | $Yb_2O_3$ | 2437 | ○ | ○ | smooth, dense | smooth, dense |

Remarks (1) As the melting point of the oxide the value of a highest temperature is shown for each, because there is a variation in accordance with documents.

(2) Forming method of coating: APS atmospheric plasma spraying method and LPPS low pressure plasma spraying method (Test 2)

In this test, the change of microstructure of the coating through the high energy irradiation treatment is observed by an optical microscope on the section of the $Y_2O_3$ spray coating among the high energy irradiated test pieces prepared in Test 1 before and after the electron beam irradiation treatment.

FIG. 1 schematically shows the change of the microstructure in the vicinity of the surfaces of the $Y_2O_3$ spray coating (porous film) and of a composite coating comprised of this coating after the electron beam irradiation treatment and an undercoat layer. In the non-irradiated test piece shown in FIG. 1(*a*), the surface roughness is large because the spraying particles constituting the coating are existent independently. On the other hand, a new layer having a different microstructure is formed on the spray coating through the electron beam irradiation treatment shown in FIG. 1(*b*). This layer is a dense layer having fewer pores formed by fusing the spraying particles each other. Moreover, FIG. 1 (*c*) shows an example of the coating having an undercoat.

Further, it can be confirmed that a coating having many pores inherent to the spray coating is existent below the dense layer produced by the electron beam irradiation, which is a layer having an excellent resistance to thermal shock.

(Test 3)

Figure 2:
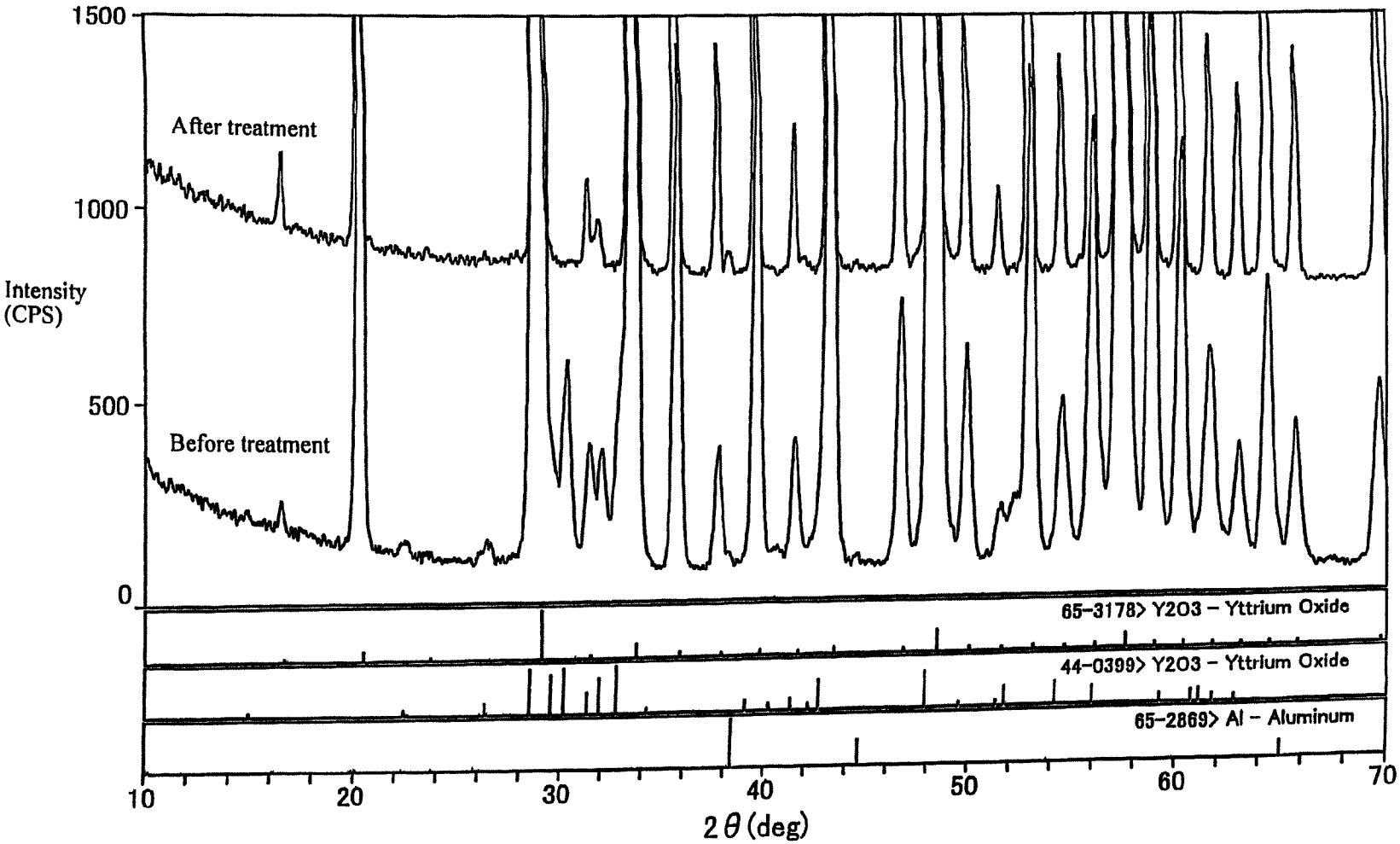
FIG. 2 is an X-ray diffraction view of a secondary recrystallized layer produced by subjecting a spray coating (porous layer) to an electron beam irradiation treatment.
Figure 3:
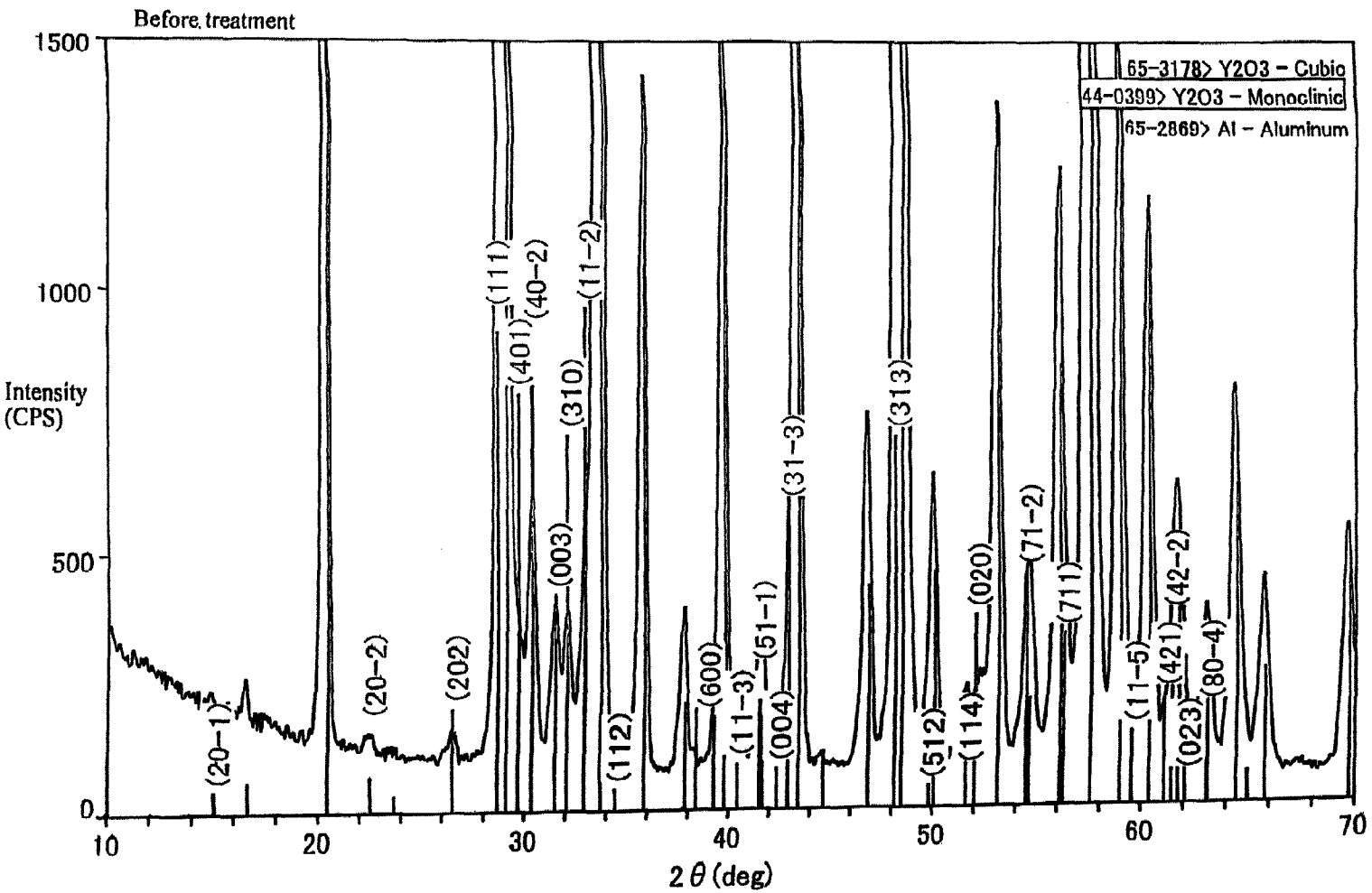
FIG. 3 is an X-ray diffraction view of $Y_2O_3$ spray coating before an electron beam irradiation treatment.
Figure 4:
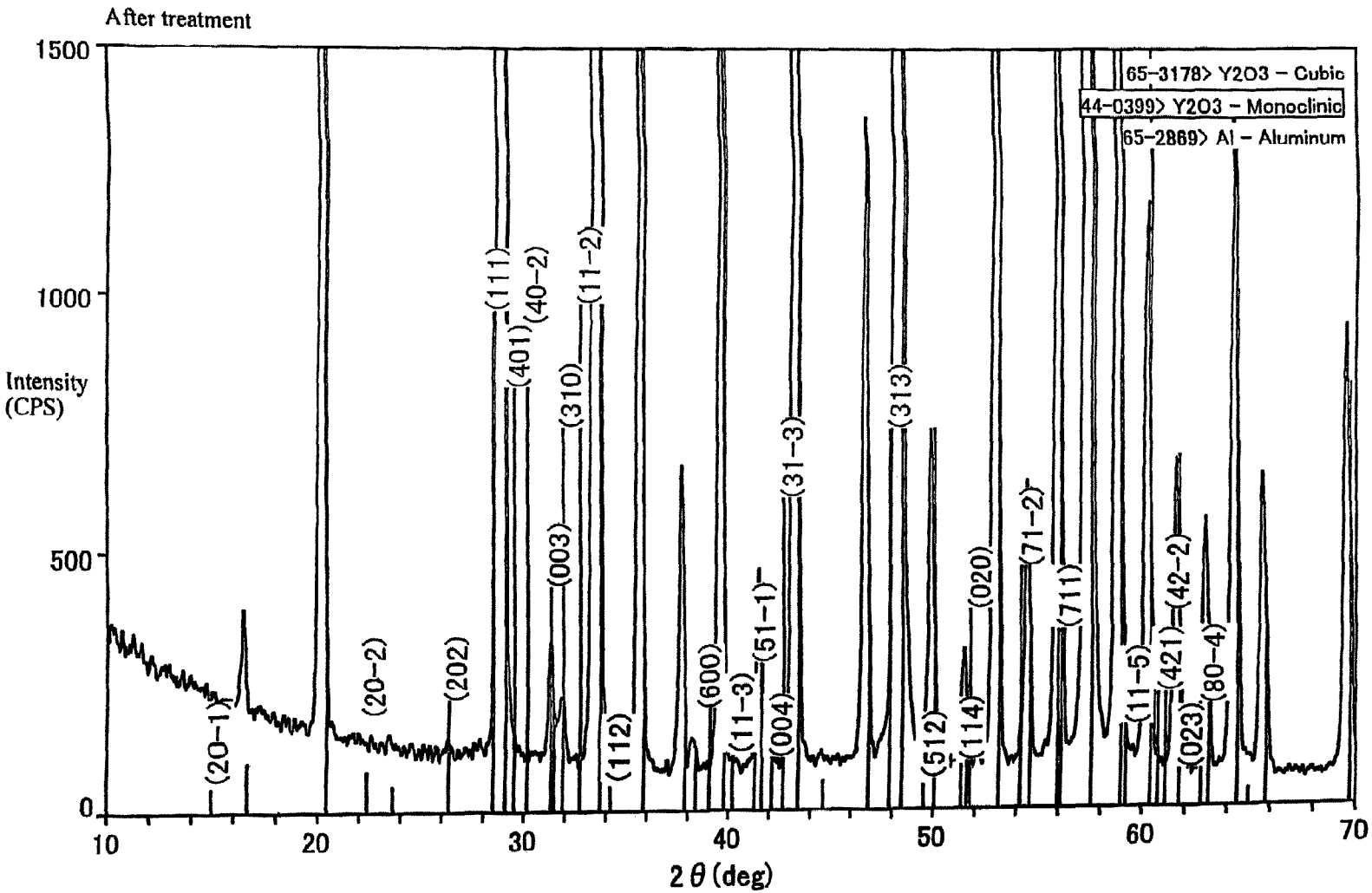
FIG. 4 is an X-ray diffraction view of a secondary recrystallized layer after an electron beam irradiation treatment.

This test is carried out for examining the crystal structure by measuring the porous layer of $Y_2O_3$ spray coating of FIG. 1(*a*) and the secondary recrystallized layer of FIG. 1(*b*) produced by the electron beam irradiation treatment under the following conditions through XRD. The results shown in FIG. 2 shows an XRD pattern before the electron beam irradiation treatment. FIG. 3 is an X-ray diffraction chart by enlarging the ordinate before the treatment, and FIG. 4 is an X-ray diffraction chart by enlarging the ordinate after the treatment. As seen from FIG. 3, a peak indicating a monoclinic system is particularly observed within a range of 30-35° in the sample before the treatment, which shows a state of mixture of the cubic system and the monoclinic system. On the contrary, as shown in FIG. 4, the secondary recrystallized layer after the electron beam irradiation treatment is confirmed to be only the cubic system because a peak indicating $Y_2O_3$ particles becomes sharp and the peak of the monoclinic system attenuates and a plane index such as (202) and (310) could not be found. Moreover, the measurement of this test is carried out by using an X-ray diffractometer RINT1500X made by Rigaku Denki Co., Ltd.

In FIG. 1, numeral 1 is a substrate, numeral 2 a porous layer (deposition layer of spraying particles), numeral 3 a pore (space), numeral 4 an interface of particles, numeral 5 a through-hole, numeral 6 a secondary recrystallized layer produced by an electron beam irradiation treatment, and numeral 7 an undercoat. Moreover, the change of microstructure similar to that of the electron beam irradiated surface is observed by means of the optical microscope even after the laser beam irradiation treatment.

EXAMPLE 1

In this example, an undercoat (spray coating) of 80 mass % Ni-20 mass % Cr is formed on a surface of an Al substrate (size: 50 mm×50 mm×5 mm) by an atmospheric plasma spraying method and a porous coating is formed thereon with powders of $Y_2O_3$ and $CeO_2$ by the atmospheric plasma spraying method, respectively. Thereafter, the surfaces of the spray coating are subjected to two kinds of high energy irradiation treatments, i.e. electron beam irradiation and laser beam irradiation. Then, the surface of the thus obtained coating to be tested is subjected to a plasma etching work under the following conditions. The number of particles of coating element scraped and flying from the coating through the etching treatment is measured to examine the resistance to plasma erosion and the resistance to environmental contamination. The comparison is conducted by measuring a time that 30 particles having a particle size of 0.2 μm or more adhere to the surface of a silicon wafer of 8 inches in diameter placed in the vessel.

(1) Atmosphere gas and flow conditions

As F-containing gas, $CHF_3/O_2/Ar$=80/100/160 (flow amount $cm^3$ per 1 minute)

As CH-containing gas, $C_2H_2/Ar$=80/100 (flow amount $cm^3$ per 1 minute)

(2) Plasma irradiation output

High frequency power: 1300 W

Pressure: 4 Pa

Temperature: 60° C.

(3) Plasma etching test a. test in F-containing gas atmosphere b. test in CH-containing gas atmosphere c. test in an atmosphere alternately repeating F-containing gas atmosphere 1 h ↔CH-containing gas atmosphere 1 h The test results are shown in Table 2. As seen from the results of this table, the amount of particles generated by the erosion of the coating in the treatment with the F-containing gas atmosphere is larger and the time for adhering 30 particles is shorter than those in the treatment with the CH-containing gas atmosphere. However, when the plasma etching environment is constituted by alternately repeating both the gas atmospheres, the amount of the particles generated becomes further larger. This is considered due to the fact that the chemical stability of the particles on the surface of the coating is damaged by repeating fluorination (oxidation) reaction of the particles on the surface of the coating in the F-containing gas and reduction reaction in the CH-containing gas atmosphere, and hence the bonding force between the mutual particles lowers and the fluoride as a relatively stable coating element is easily flown by the etching action of the plasma.

On the contrary, in case of the test coating obtained by the electron beam irradiation or laser beam irradiation, it is confirmed that the flying amount of the particles is very small even under the atmosphere condition of alternately repeating the F-containing gas and the CH-containing gas, and the resistance to plasma erosion is excellent.

Moreover, the main element adhered to the surface of the silicon wafer is Y(Ce), F, C as spray-coated, while in the case of electron beam or laser beam irradiated coating (secondary recrystallized layer), among the element of the particles generated, the coating element is hardly recognized and F and C are recognized instead.

TABLE 2

| No. | Film forming material | Film forming method | Time (h) till the amount of particles generated exceeds an acceptable value: at a state of forming film: F-containing gas | CH-containing gas | Repetition of F-containing gas and CH-containing gas | After electron beam irradiation | After laser beam irradiation |
|---|---|---|---|---|---|---|---|
| | | | | | | Repetition of F-containing gas and CH-containing gas | |
| 1 | Y2O3 | spraying | 70 or less | 100 or more | 35 | 100 or more | 100 or more |
| 2 | CeO2 | spraying | 70 or less | 100 or more | 32 | 100 or more | 100 or more |

Remarks (1) By the atmospheric plasma spraying method, the thickness of the undercoat (80Ni-20Cr) is 80 μm and the thickness of the oxide as a top coat is 150 μm (2) Composition of F-containing gas: $CHF_3/O_2/Ar=80/100/160$ (flow amount $cm^3$ per 1 minute)

(3) Composition of CH-containing gas: $C_2H_2/Ar=80/100$ (flow amount $cm^3$ per 1 minute)

(4) Thickness of secondary recrystallized layer: 2-3 μm in electron beam irradiation treatment, 5-10 μm in laser beam irradiation treatment

EXAMPLE 2

In this example, a coating is formed by spraying a film-forming material as shown in Table 3 onto a surface of an Al substrate having a size of 50 mm×100 m×5 mm. Thereafter, a part of the coating is subjected to an electron beam irradiation treatment for forming a secondary recrystallized layer suitable for the invention. Then, a specimen having a size of 20 mm×20 mm×5 mm is cut out from the resulting treated coating and is masked so as to expose an area of 10 mm×10 mm, which is subjected to a plasma irradiation under the following conditions, and thereafter an amount damaged through plasma erosion is measured by means of an electron microscope or the like.

(1) Gas atmosphere and flowing condition $CF_4/Ar/O_2=100/1000/10$ ml (flow amount per 1 minute)

(2) Plasma irradiation output

High frequency power: 1300 W

Pressure: 133.3 Pa

The above results are summarized in Table 3. As seen from the results of this table, all of the anodized coating (No. 8), $B_4C$ spray coating (No. 9) and quartz (non-treated No. 10) as a comparative example are large in the amount damaged through plasma erosion and are not practical.

On the contrary, it is seen that the coatings having a secondary recrystallized layer as an outermost layer (No. 1-7) show the erosion resistance to a certain extent at a sprayed state because the Group IIIb element is used as a film forming material, and particularly when these coatings are subjected to the electron beam irradiation treatment, the resistance force is considerably enhanced and the amount damaged through plasma erosion is reduced by 10-30%.

TABLE 3

| No. | Film forming material | Film forming method | Amount damaged through plasma erosion (μm): at film-formed state | after electron beam irradiation | Remarks |
|---|---|---|---|---|---|
| 1 | $Sc_2O_3$ | spraying | 8.2 | 0.1 or less | Invention |
| 2 | $Y_2O_3$ | spraying | 5.1 | 0.2 or less | Examples |
| 3 | $La_2O_3$ | spraying | 7.1 | 0.2 or less | |
| 4 | $CeO_2$ | spraying | 10.5 | 0.3 or less | |
| 5 | $Eu_2O_3$ | spraying | 9.1 | 0.3 or less | |
| 6 | $Dy_2O_3$ | spraying | 8.8 | 0.3 or less | |
| 7 | $Yb_2O_3$ | spraying | 11.1 | 0.4 or less | |
| 8 | $Al_2O_3$ | anodizing | 40 | — | Comparative |
| 9 | $B_4C$ | spraying | 28 | — | Examples |
| 10 | quartz | | 39 | — | |

Remarks (1) Spraying is an atmospheric plasma spraying method (2) Thickness of spray coating is 130 μm (3) Anodized film is formed according to AA25 of JIS H8601

(4) Thickness of layer containing secondary recrystallized layer through electron beam irradiation is 3-5 μm

EXAMPLE 3

In this example, the resistance to plasma erosion in the coating formed by the method of Example 2 before and after the electron beam irradiation treatment is examined. As a specimen to be tested, ones obtained by directly forming the following mixed oxide onto an Al substrate at a thickness of 200 μm through an atmospheric plasma spraying method are used.

(1) 95% $Y_2O_3$-5% $SC_2O_3$ (2) 90% $Y_2O_3$-10% $Ce_2O_3$ (3) 90% $Y_2O_3$-10% $Eu_2O_3$

Moreover, the electron beam irradiation and gas atmosphere element after the film formation, plasma irradiation conditions and the like are the same as in Example 2.

The above results are summarized in Table 4 as an amount damaged through plasma erosion. As seen from the results of this table, the coatings of oxides in Group IIIb of the Periodic Table under the conditions adaptable for the invention are better in the resistance to plasma erosion even in the use at the mixed oxide state as compared with the $Al_2O_3$ (anodizing) and $B_4C$ coatings disclosed as a comparative example in Table 3. Particularly, when the coatings are subjected to the electron beam irradiation treatment, the performances are considerably improved and the excellent resistance to plasma erosion is developed.

TABLE 4

| No. | Film forming material | Film forming method | Amount damaged through plasma erosion (μm) at film-formed state | Amount damaged through plasma erosion (μm) after electron beam irradiation |
|---|---|---|---|---|
| 1 | 95% $Y_2O_3$-5% $Sc_2O_3$ | spraying | 5.5 | 0.3 or less |
| 2 | 90% $Y_2O_3$-10% $CeO_2$ | spraying | 8.5 | 0.2 or less |
| 3 | 90% $Y_2O_3$-10% $Eu_2O_3$ | spraying | 7.6 | 0.3 or less |

Remarks (1) Numerical value in the column of Film forming material is mss %

(2) Spraying is an atmospheric plasma spraying method (3) Thickness of layer containing secondary recrystallized layer through electron beam irradiation is 3-5 μm

INDUSTRIAL APPLICABILITY

The technique of the invention is used as a surface treating technique for not only the members, parts and the like used in the general semiconductor processing apparatus but also members, parts and the like used in a plasma treating apparatus requiring more precise and advanced processing lately. Particularly, the invention is preferable as a surface treating technique for members, parts and the like in an apparatus using F-containing gas or CH-containing gas alone or a semiconductor processing device subjected to a plasma treatment in a severe atmosphere alternately repeating these gases such as deposit shield, baffle plate, focus ring, upper-lower insulator ring, shield ring, bellows cover, electrode and solid dielectric substance. Also, the invention may be applied as a surface treating technique for members in a liquid crystal device producing apparatus.

What is claimed is:

1. A ceramic coating member for a semiconductor processing apparatus, comprising:

a substrate;

a porous layer coated onto a surface of the substrate, the porous layer comprising a spray coating consisting of an oxide of one or more elements in Group IIIb of the Periodic Table and including a cubic crystal structure of the oxide and a primary transformed monoclinic crystal structure of the oxide; and a secondary recrystallized layer formed on the porous layer and including a secondary transformed cubic crystal structure of the oxide which includes at least a surface of the primary transformed monoclinic crystal structure which is transformed into the secondary transformed cubic crystal structure.

2. A ceramic coating member for a semiconductor processing apparatus according to claim 1, further comprising an undercoat disposed between the substrate and the porous layer.

3. A ceramic coating member for a semiconductor processing apparatus according to claim 1 or 2, wherein the substrate comprises (i) a metal or metal alloy, which includes aluminum and an alloy thereof, titanium and an alloy thereof, stainless steel, special steels, Ni-based alloy, other metals and alloys thereof, or a mixture of two or more thereof (ii) a ceramic which includes quartz, glass, an oxide, a carbide, a boride, a silicide, a nitride, or a mixture thereof, (iii) a cermet of the ceramic and the metal or alloy, (iv) plastics, (v) a metal plating, electric plating, fusion plating, chemical plating or a metal deposited film formed on the surface of the above material (i)-(iv).

4. A ceramic coating member for a semiconductor processing apparatus according to claim 1 or 2, wherein the porous layer consists of an oxide of Sc, Y or a lanthanide of atom number 57-71 (La, Ce, Pr, Nb, Pm, Sm, Eu, Gd, Tb, Dy, Ho, Er, Tm, Yb, Lu), or a combination of two or more thereof.

5. A ceramic coating member for a semiconductor processing apparatus according to claim 1 or 2, wherein the porous layer is a plasma spray coating having a layer thickness of about 50-2000μm and a porosity of about 5-20%.

6. A ceramic coating member for a semiconductor processing apparatus according to claim 1 or 2, wherein the secondary recrystallized layer is a high energy irradiation treated layer formed by changing the primary transformed monoclinic crystal structure of the oxide included in the porous layer into the secondary transformed cubic crystal structure of the oxide through a high energy irradiation treatment.

7. A ceramic coating member for a semiconductor processing apparatus according to claim 1 or 2, wherein the secondary recrystalized layer is a high energy irradiation treatment layer having a porosity of less than 5%.

8. A ceramic coating member for a semiconductor processing apparatus according to claim 1 or 2, wherein:

the spray coating consisting of yttrium oxide having a cubic crystal structure of yttrium oxide and a primary transferred monoclinic crystal structure of yttrium oxide and the secondary recrystallized layer is a layer formed by subjecting the spray coating of yttrium oxide to a high energy irradiation treatment to provide a secondary transformed cubic crystal structure of the yttrium oxide which includes at least a surface of the primary transformed monoclinic crystal structure of the yttrium oxide which is transformed into the secondary transformed cubic crystal structure of the yttrium oxide.

9. A ceramic coating member for a semiconductor processing apparatus according to claim 1 or 2, wherein the secondary recrystallized layer has a maximum roughness (Ry) of about 6-16μm.

10. A ceramic coating member for a semiconductor processing apparatus according to claim 1 or 2, wherein the secondary recrystallized layer has an average roughness (Ra) of about 3-6μm.

11. A ceramic coating member for a semiconductor processing apparatus according to claim 1 or 2, wherein the secondary recrystallized layer has a 10-point average roughness (Rz) of about 8-24 μm.

12. A ceramic coating member for a semiconductor processing apparatus according to claim 1 or 2, wherein the secondary recrystallized layer has a total layer thickness of about 100μm or less.

13. A ceramic coating member for a semiconductor processing apparatus according to claim 2, wherein the undercoat is a coating film made of at least one selected from Ni, Al, W, Mo, Ti and an alloy thereof, at least one ceramic of an oxide, a nitride, a boride and a carbide and a cermet consisting of the above metal, alloy and ceramic and having a thickness of about 50-500 μm.

14. A ceramic coating member for a semiconductor processing apparatus according to claim 6, wherein the high energy irradiation treated layer is an electron beam irradiation treated layer or a laser beam irradiation treated layer.

15. A ceramic coating member for a semiconductor processing apparatus according to claim 7, wherein the high energy irradiation treated layer is an electron beam irradiation treated layer or a laser beam irradiation treated layer.

16. A ceramic coating member for a semiconductor processing apparatus, comprising:

a substrate;

a porous layer coated onto a surface of the substrate, the porous layer consisting of yttrium oxide; and a secondary recrystallized layer of the oxide formed on the porous layer, the secondary recrystallized layer being a layer formed by subjecting a surface of the primary transformed spray coating of yttrium oxide consisting of a cubic crystal and a monoclinic crystal to a high energy irradiation treatment to provide a secondary transformed cubic crystal structure of the yttrium oxide that has been secondary transformed from the primary transformed monoclinic crystal structure of the yttrium oxide.

* * * * *